US008468778B2

(12) United States Patent
Windheuser

(10) Patent No.: US 8,468,778 B2
(45) Date of Patent: Jun. 25, 2013

(54) SINGLE-HAND SELF-CONTAINED COHESIVE STRETCH FILM BAGGAGE WRAPPING DEVICE

(76) Inventor: Friedrich Windheuser, Punta del Este (UY)

( * ) Notice: Subject to any disclaimer, the term of this patent is extended or adjusted under 35 U.S.C. 154(b) by 0 days.

(21) Appl. No.: 13/243,296

(22) Filed: Sep. 23, 2011

(65) Prior Publication Data

US 2013/0074446 A1 Mar. 28, 2013

(51) Int. Cl.
*B65B 45/00* (2006.01)

(52) U.S. Cl.
USPC ..... 53/219; 53/218; 53/203

(58) Field of Classification Search
USPC ..... 53/399, 203, 210, 218, 219
See application file for complete search history.

(56) References Cited

U.S. PATENT DOCUMENTS

| | | | | | |
|---|---|---|---|---|---|
| 3,578,747 | A | | 5/1971 | Schramm | |
| 3,815,313 | A | | 6/1974 | Heisler | |
| 4,102,513 | A | | 7/1978 | Guard | |
| 4,179,081 | A | * | 12/1979 | Parry | 242/422.1 |
| 4,248,392 | A | * | 2/1981 | Parry | 242/422.1 |
| 4,484,717 | A | * | 11/1984 | Goldstein | 242/422.1 |
| 4,575,020 | A | * | 3/1986 | Strout et al. | 242/422.1 |
| 4,600,163 | A | * | 7/1986 | Hummel et al. | 242/422.1 |
| 4,706,442 | A | * | 11/1987 | Riemenschneider | 53/556 |
| 4,783,950 | A | | 11/1988 | Santagati | |
| 4,834,312 | A | * | 5/1989 | Riemenschneider, III | 242/588.2 |
| 4,872,623 | A | | 10/1989 | Parry | |
| 4,989,803 | A | | 2/1991 | Lambert | |
| 5,062,217 | A | | 11/1991 | Tolson | |
| 5,203,517 | A | * | 4/1993 | Parry et al. | 242/422.4 |
| 5,299,406 | A | | 4/1994 | Laury | |
| 5,329,747 | A | | 7/1994 | Williams, Jr. | |
| 5,351,905 | A | | 10/1994 | Ferber | |
| 5,368,666 | A | | 11/1994 | Terada | |
| 5,440,102 | A | | 8/1995 | Pena | |
| 5,451,282 | A | | 9/1995 | Fore | |
| 5,531,059 | A | | 7/1996 | Dickinson | |
| 5,784,864 | A | | 7/1998 | Laury | |
| 5,890,345 | A | | 4/1999 | Bauer | |
| 6,513,751 | B2 | * | 2/2003 | Michel | 242/571.1 |
| 6,691,496 | B2 | | 2/2004 | Pena | |
| 6,761,014 | B2 | | 7/2004 | Cerf | |
| 7,380,744 | B1 | * | 6/2008 | Yu Chen | 242/422.4 |
| 7,401,449 | B2 | * | 7/2008 | Watson et al. | 53/399 |
| 7,522,053 | B2 | | 4/2009 | Johnson | |
| 7,543,426 | B1 | * | 6/2009 | Phero | 53/592 |
| 7,665,686 | B2 | | 2/2010 | Becker | |
| 7,937,915 | B2 | * | 5/2011 | Kohn et al. | 53/556 |
| 2002/0047067 | A1 | * | 4/2002 | Michel | 242/571.1 |
| 2008/0088125 | A1 | | 4/2008 | Montross | |

* cited by examiner

*Primary Examiner* — Christopher Harmon
(74) *Attorney, Agent, or Firm* — Furr Law Firm; Jeffrey Furr, Esq.

(57) ABSTRACT

The invention is a do-it-yourself baggage wrapping, protection, anti-tamper and anti-pilferage device. The all-in-one device consists of the stretch film, a dispenser able to draw, stretch and wrap film up to 12 inches in width, consisting of a stopper-ring secured at the very beginning of the extended core followed by a semi-compressible sleeve with embedded guide rings encircling core extension contoured guide-rings or an anti-clockwise coiled and freely rotating spiral-shape flexible sheet to let freely rotate same when film is being drawn off roll, thus followed by a second stopper-ring secured about one inch from the remote end of core extension. Both stopper-rings are dimensioned to prevent the sleeve from separating from the extension at any position or angle and total spacing between the two is greater than the total length of the sleeve to provide free rotation of latter.

7 Claims, 13 Drawing Sheets

FIG. 8/A

SINGLE-HAND SELF-CONTAINED COHESIVE STRETCH FILM BAGGAGE WRAPPING DEVICE

CROSS-REFERENCES TO RELATED APPLICATIONS (IF ANY)

None

STATEMENT AS TO RIGHTS TO INVENTIONS MADE UNDER FEDERALLY-SPONSORED RESEARCH AND DEVELOPMENT (IF ANY)

None

BACKGROUND OF INVENTION

Field of the Invention

This invention relates to plastic stretch-film baggage wrapping in general, a field so far dominated by the monopoly of sole machine stretch-film baggage wrapping located at airports as no known specific one-handed manual stretch-film baggage wrapper exist, more particular to a one-hand held and self-contained cohesive stretch film baggage wrapping device having the ability to perform a complete do-it-yourself baggage wrap, by incorporating both the stretch film of up to 12 inches 304.80 mm, in width, with ample film footage for a complete single mono-use baggage wrap and film dispenser able to draw, stretch and wrap film up to 12 inches, 304.80 mm in width, providing a positive braking tension insuring that the film will be stretched, wrapping the baggage accordingly by providing complete baggage wrapping, protection, anti-tampering, and anti-pilferage.

1. Technical Field

This invention is directed to the do-it-yourself baggage wrapping and protection of baggage, more particularly the manual wrapping of baggage in cohesive stretch-film to protect the exterior of the baggage and to prevent tampering with the contents of same.

2. Description of the Prior Art

At a time when air travel has come to be a common place aspect of our lives, the rate of tampered and damaged bags has continued to climb steadily. Yet, no manual, do-it-yourself, easy, safe, and inexpensive method of baggage protection has been invented until now as no known one-handed manual stretch film baggage wrapping device exist and all of the stretch-film baggage wrapping devices and services publicly available are sole machine operated and are placed directly inside terminal buildings of airports all over the world by multi-national companies creating a monopoly of service at very high prices of up to USD 15 per single baggage wrap which most travelers cannot afford especially in today's challenging economical times.

Other forms of baggage protection involve even more expensive sheaths, custom-fitted for each bag.

Therefore, there is a need for a do-it-yourself, easy, self-contained, safe, and inexpensive method of baggage wrapping and protection, a need which the present invention addresses as it is also able to use and manually draw, stretch and wrap stretch-film of up to an exceptional width of 12 inches, 304.80 mm by one-handed use. while any closest one-handed prior-art such as one-handed banding stretch film dispensers (U.S. Pat. No. 5,351,905) which are tailored for bundling, collating small products can only handle film widths of maximum 6 inches, 152.4 mm and are not designed for baggage wrapping due to their inability of handling suitable larger film widths.

Another prior-art (U.S. Pat. No. 7,665,686) can only freely draw film of 245 mm in width while it cannot stretch and wrap film as it has no incorporated brake actions, same is therefore also not suitable for wrapping due to the inability of stretching and wrapping film and consequent inability to perform any kind of stretch-film baggage wrapping.

Use has shown that stretch-film widths from 6 inches, 152.4 mm upwards could until today only be handled by use of two-handed dispensers (U.S. Pat. No. 4,102,513) in order to be able to draw and to stretch and wrap film as otherwise stretch-wrapping would not be possible, thus making the invention one-handed device for stretch-film up to 12 inches, 304.80 mm in width unique in its design as it is able to draw, stretch and wrap stretch-film as required.

As a comparison, the machine operated stretch film baggage wrapping services at airports use a standard film width of 500 mm while the invention, able to draw, stretch and wrap, can use films up to 304.80 mm in width and the closest one-handed prior-art, although not designed for baggage wrapping, is able to draw, stretch and wrap film widths of maximum 152.40 mm.

Two-handed dispensers, although able to draw, stretch and wrap even larger films width's, cannot be used at all because during baggage wrapping one hand is always needed to keep baggage in its place while the other hand is used for holding the wrapping device and encircle-wrapping the baggage.

SUMMARY OF THE INVENTION

Considering the above, a primary object is therefore to provide a valid alternative to the present monopoly of machine baggage wrapping at airports by providing a all-in-one and do-it-yourself baggage wrapping and protection device which is easy, safe, inexpensive and can be handled in the comfort of your home, hotel or at your convenience by anybody, whether right or left-handed, as well as being of mono-use and 100% bio-degradable and recyclable. The latter being especially important when discarding the remaining parts of the device after use.

Another object is to provide a baggage protection device capable of implementing the desired baggage protection method against pilferage, manipulation such as placing drugs or other illegal items inside luggage without knowledge of owner, damage as well as creating a tamper-evident barrier.

Yet, another object is to provide a baggage protection method and device which will not harm baggage.

Still another object is to provide a baggage protection method and device which can protect a great variety of baggage sizes and shapes.

Another object is to provide a baggage protection method and device which is rapid and fairly easy to handle by anybody, obtaining wrapping results at par with machine stretch-film baggage wrapping quality at airports Another object is to provide a baggage protection method which can be quickly and easily removed upon reaching a destination.

Yet, another object is to provide a baggage protection method and device which can envelop a piece of baggage.

A final important object is to provide a self-contained baggage wrapping device which does not have to be carried through airport security checks which after the events of 9/11 have become extremely rigorous and severe. The device in question is being constructed as a mono-use device. The entire device and all of its remaining parts can be safely disposed of after use as being 100% bio-degradable or recyclable. Being all-in-one, no separate stretch film dispenser or roll has to be carried in any carry on hand baggage and checked through airport security or customs. Therefore, no strange or suspicious objects have to be carried along in hand baggage. Wrapping baggage for any onward or return flight can be easily achieved by placing a spare baggage wrapping device, weighting about 400 grams, inside the baggage prior to wrapping it, the wrapping device will then be ready for baggage to be packed for any return/onward flight.

The present invention provides a unique and valid alternative to the present monopoly of machine operated baggage wrapping services at airports as it delivers a do-it-yourself method for wrapping and protecting baggage as well as providing an anti-tampering and ant-pilferage barrier by wrapping the baggage in cohesive stretch-film and a device for implementing the method above. The device is designed for mono-use, to implement the method in an easy, inexpensive way and providing wrapping results at par with present machine wrapping services as well as being 100% bio-degradable/recyclable when disposed of.

As it will become clear hereinafter, the primary and necessary embodiment of the all-in-one baggage wrapping device of the above invention includes a roll of cohesive stretch-film of up to 12 inches, 304.80 mm in width on a central core provided with single end extended core onto which a stretch film dispenser is incorporated, forming a completely self-contained device.

Being of mono-use, the standardized cohesive stretch film footage contained on roll provides ample coverage for a complete single baggage wrap of any standard large sized, smaller medium, compact and cabin size baggage. The entire device, including stretch film, is 100% bio-degradable/recyclable.

As will be seen, the incorporated film dispenser is able to draw, stretch and wrap film up to 12 inches, 304.80 mm in width by one-handed use, considered exceptional for a one-hand held stretch-film wrapping device, includes a stopper-ring secured at the very beginning of the single end extended core and washer where applicable, followed by a semi-compressible sleeve with or without embedded contoured or non-contoured guide-rings where applicable encircling extended core with or without contoured or non-contoured core guide-rings where applicable or the clockwise or anti-clockwise coiled around extended core spiral-shape flexible sheet where applicable, thus followed by washer where applicable and a second stopper-ring secured about one inch prior to the remote end of the core extension to let freely rotate sleeve when the device is used with film being drawn from off the roll Both stopper-rings are dimensioned to prevent the sleeve from separating from the extension no matter what position or angle the device is being held at. The total spacing between the two stopper-rings including washers where applicable is greater than the combined total length of the semi-compressible sleeve with or without the two embedded contoured or non-contoured guide-rings where applicable included or the width of clockwise or anti-clockwise coiled around core spiral-shape flexible sheet where applicable so there is endwise freedom for free rotation.

In particular will be noted that brake action and film stretching can be achieved by use of three independent means, thus without changing hand or position:

First, the stopper-ring located at the very beginning of the extended core, being in a natural position when sleeve is held by hand, acts as brake when being grasped between thumb and index finger.

Second, the area of the semi-compressible sleeve covered by thumb and forefinger when same is grasped by hand during free rotation of core, acts as brake when squeezed between thumb and index finger.

Third, the very last inch of extended core acts as brake when being grasped by baby finger during normal handling of device. All three means provide separate brake use and prevent rotation of core when stretching film or to be broken from roll.

Wrapping and protecting a piece of baggage is implemented as follows:

First, a piece of baggage is placed on a convenient support base (floor, table etc.) ready for the packing procedure.

Second, a sufficient length of stretch-film, 2 ft (60 cm), is drawn freely by hand from the device without stretching and the beginning of film with the outer end first is secured by hand to baggage, where it will adhere, slight tension is kept on the film by using anyone of the device's single brake actions available while simultaneously drawing further footage off roll and encircle wrapping the baggage just once until the beginning of film has been fully overlapped thus ensuring sufficient adherence and anchorage of film around baggage and to itself and permitting to continue with the actual progressive spiral and stretch wrapping process while keeping film under tension and proceeding as indicated next.

Third, with the film already attached to baggage and under slight tension, another 1½-2 ft (45-60 cm) of film at a time are freely drawn, without stretching, off the roll, thereafter using anyone of the device's single brake actions available, the film is then stretched about 50-100% obtaining about 2 ft-3 ft (60-90 cm) of stretched film which is then tightly spiral-wrapped, by keeping film under tension, around the baggage where it will automatically adhere to the baggage and/or to itself.

By spiral-wrapping, the film must overlap the previous layer of film about 50% or to such extend to provide complete wrapping coverage of baggage.

Change of wrapping direction from horizontal to vertical or vice versa without cutting film, is achieved by simply twisting the device about 180°-360° with same hand and proceeding with wrapping as usual.

Fourth, the previous step 3 must be repeated until and when the baggage is completely spiral-wrapped and the stretch film provided on roll is exhausted or using any of the brake action provided to brake film off the roll to interrupt wrapping.

Fifth, when wrapping is terminated, the free end of the stretch film is then secured to the wrapped piece of baggage to complete the process and a adhesive security label, supplied with device, is placed over the free end to avoid accidental loosening of same during transport. After this, all remaining parts of the mono-use device can then be safely disposed of as same is 100% bio-degradable and recyclable.

Wrapping results obtained are at par with machine stretch-film baggage wrapping.

The device is easy, safe and inexpensive and provides the best combination at present of cost-effectiveness and ease and can be used by anybody and with almost any type of baggage including golf clubs, skies etc.

BRIEF DESCRIPTION OF THE DRAWINGS

These and other features of the invention will be more clearly understood from a consideration of the following description, taken in connection with the accompanying drawings, in which:

FIG. 11 shows the invention, in a preferred embodiment for one-handed operation and use of the semi-compressible sleeve as reliable braking action as it would appear during wrapping; and.

FIG. 12 shows the invention, in a preferred embodiment for one-handed operation and use of the very last inch of the extended core as reliable braking action as it would appear during wrapping; and.

DETAILED DESCRIPTION

Figure 1:
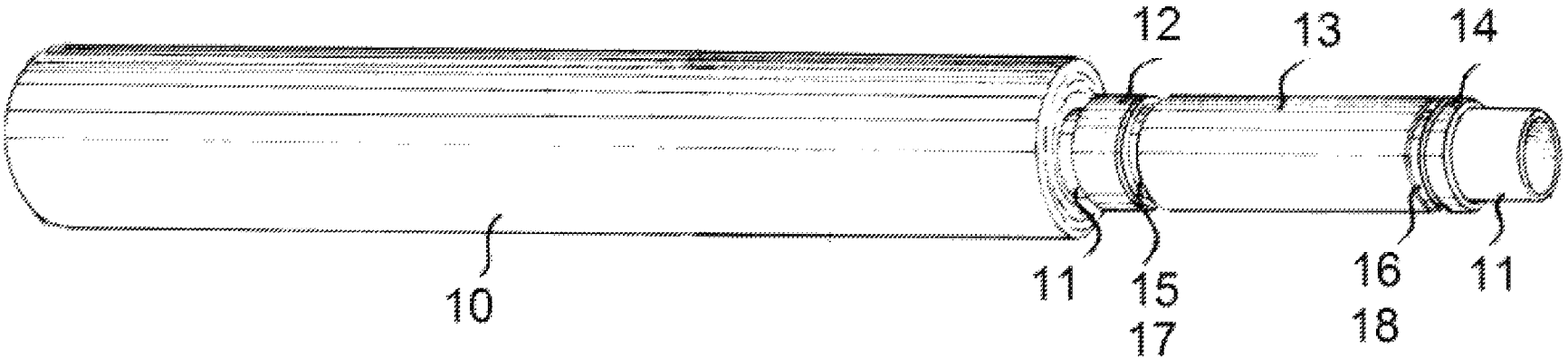
FIG. 1 shows the mono-use cohesive stretch film baggage wrapping device of the invention in reduced scale, in a preferred embodiment for one-handed operation, as it would appear in final construction.
Figure 2:
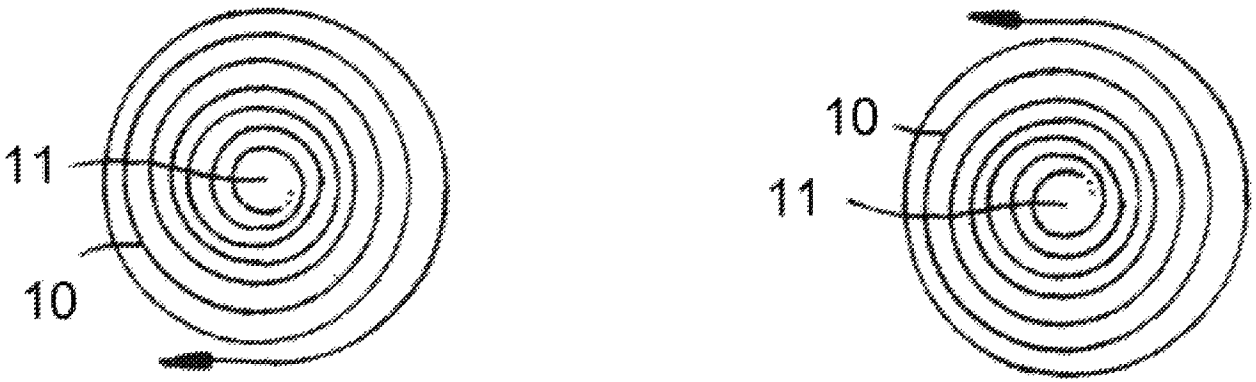
FIG. 2 illustrates the clockwise and anti-clockwise direction drawing of stretch film from off the roll of FIG. 1.

The current invention, apart from the stretch-film, guide-rings, spiral-shape flexible sheet and some version of the semi-compressible sleeve, was constructed of hard cardboard material. All material used, including stretch film, guide-rings, semi-compressible sleeve, is 100% bio-degradable or recyclable The current invention is a completely self-contained cohesive stretch film baggage wrapping device of the invention for one-handed use consisting of a roll of cohesive stretch-film of up to 12 inches, 304.80 mm in width 10 on a central core with a single end extension 11 onto which a stretch film dispenser as shown in FIG. 4, FIG. 5, FIG. 6, FIG. 7, FIGS. 8 and 8/A, FIGS. 9 and 9/A with the ability to draw, stretch and wrap film up to 12 inches, 304.80 mm in width is incorporated forming a single entity with stretch-film roll and single end extension is shown in FIG. 1. As indicated in the FIG. 2 in its preferred embodiment the stretch-film 10 comes off when rotating the roll in a clockwise direction but if required, the stretch-film 10 comes also off when rotating roll in a anti-clockwise direction depending on positioning of dispenser or unwinding direction of film roll.

Figure 7:
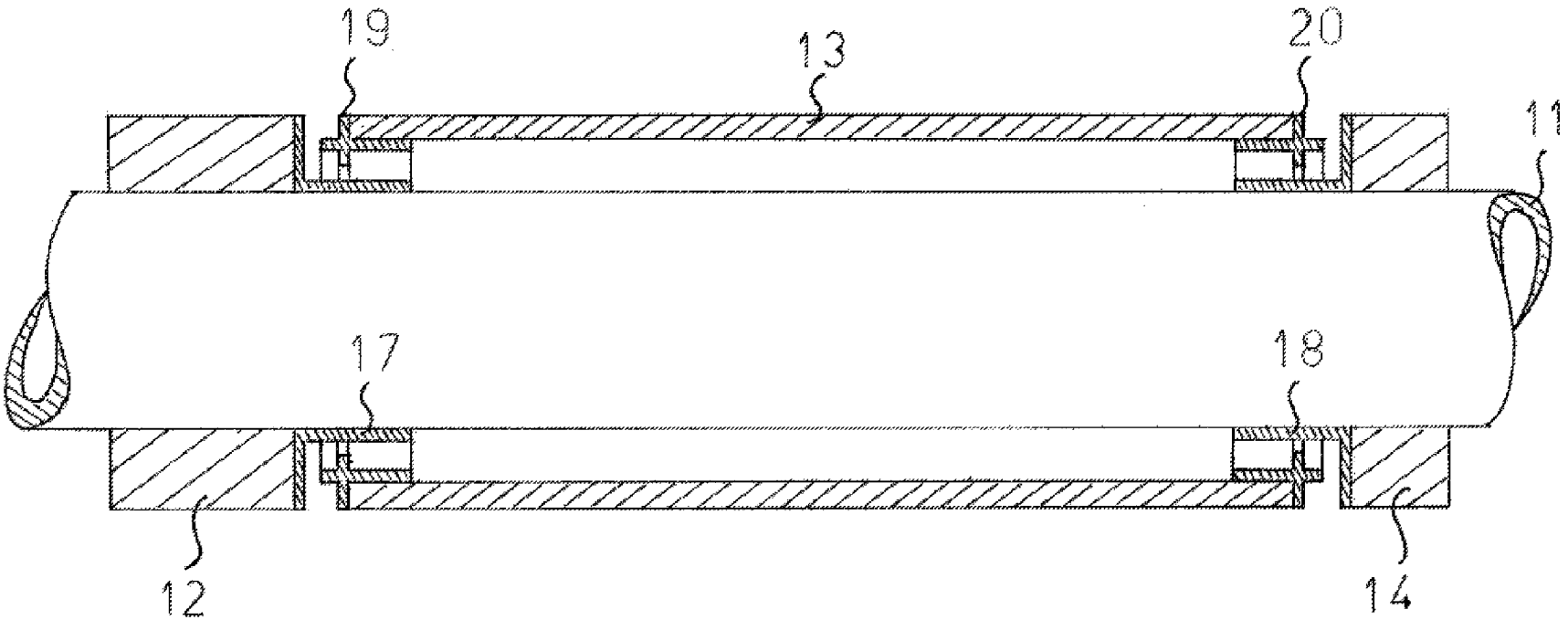
FIG. 7 illustrates film dispenser version number two, shows a enlarged cross-section view of inner stopper-ring, semi-compressible sleeve (including embedded contoured guide-rings) as well as outer stopper-ring when assembled around extended core and contoured core guide-rings in a preferred embodiment as it would appear in final construction.
Figure 8:
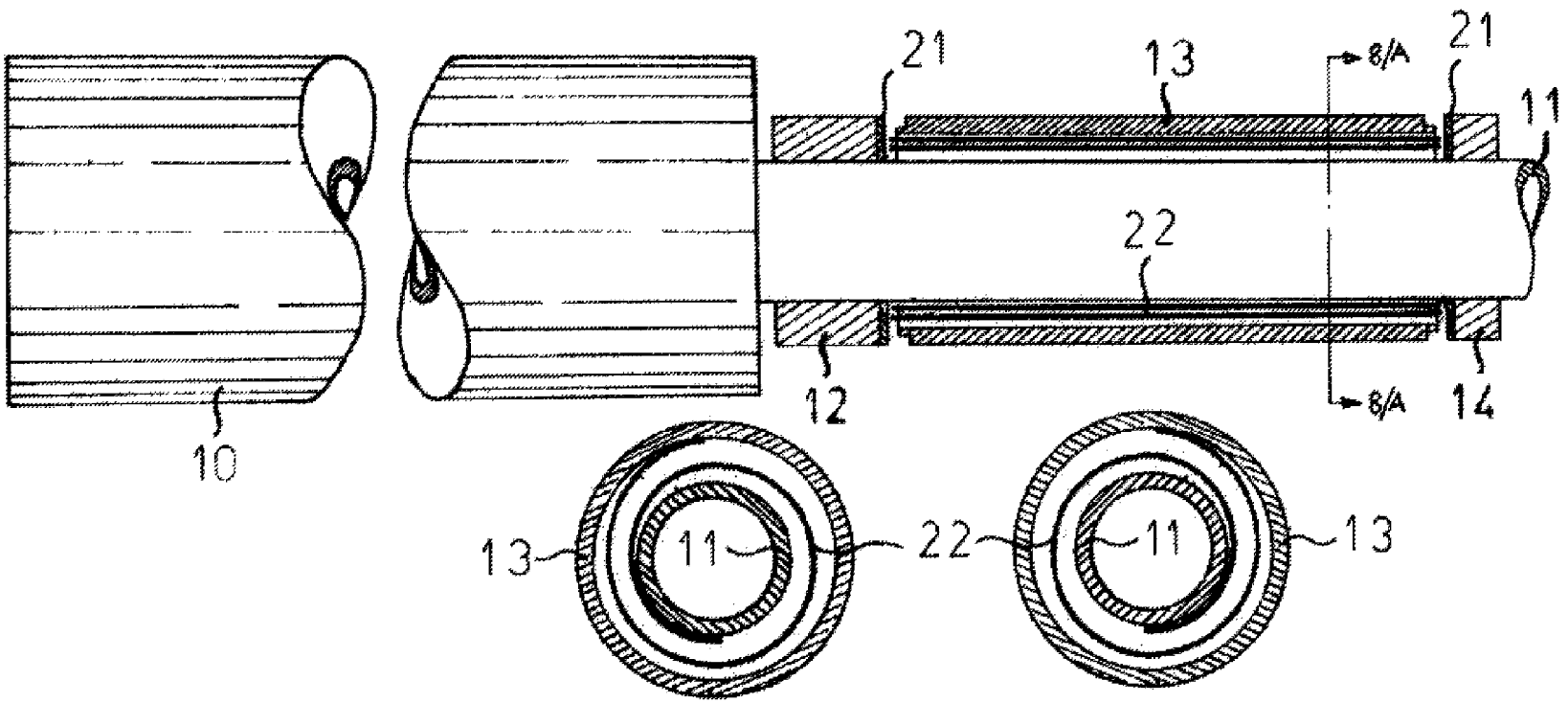
FIG. 8 and FIG. 8/A illustrates mounted film dispenser version number three of the mono-use cohesive stretch film baggage wrapping device of the invention, shows a partial cross-section view of inner stopper-ring, inner washer, semi-compressible sleeve (without guide-rings), the clockwise or anti-clockwise direction coiled around core spiral-shape flexible sheet (clockwise or anti-clockwise coiling depending on unwinding direction of film from off the roll) located between core extension and semi-compressible sleeve, as well as outer washer and outer stopper-ring when assembled around extended core in a preferred embodiment as it would appear in final construction.
Figure 9:
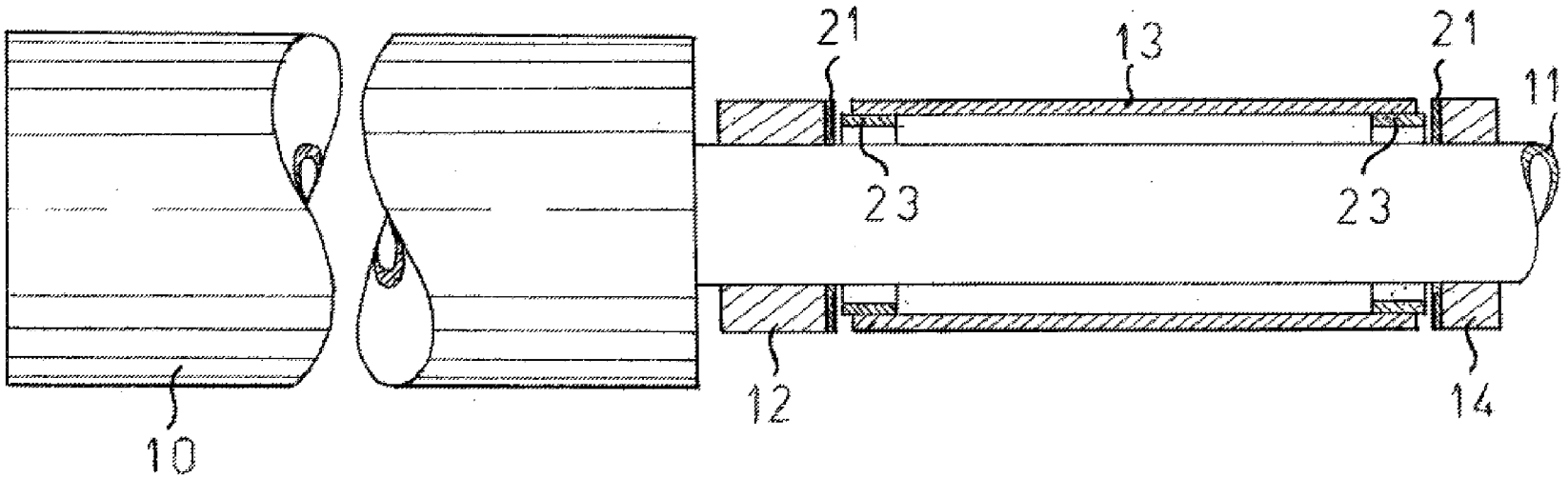
FIG. 9 illustrates mounted film dispenser version number four of the mono-use cohesive stretch film baggage wrapping device of the invention, shows a partial cross-section view of inner stopper-ring, inner washer, semi-compressible sleeve (including embedded guide-rings) as well as outer washer and outer stopper-ring when assembled around extended core in a preferred embodiment as it would appear in final construction.

As shown in FIG. 4, FIG. 5, FIG. 6, FIG. 7, FIGS. 8 and 8/A, FIG. 9 the incorporated film dispenser has four different alternative preferred embodiments as with regard to the semi-compressible sleeve 13, embedded contoured guide-rings 19 and 20, embedded non-contoured guide rings 23, core embedded contoured guide-rings 15, 16 and non-contoured guide-rings 17, 18, washers 21, and clockwise or anti-clockwise coiled around core spiral-shape flexible sheet 22.

All dispenser embodiments maintain the necessary limited surface contact exposure of the semi-compressible sleeve 13 comprising its embedded guide-rings 19, 20 and 23 with extended core 11 and its guide-rings 15, 16, 17, 18 including both lateral stopper-rings 12 and 14 as well as lateral washers 21 and clockwise or anti-clockwise coiled around core 11 spiral-shape flexible sheet 22, thus providing low inertia and optimal free rotating abilities of core.

Figure 4:
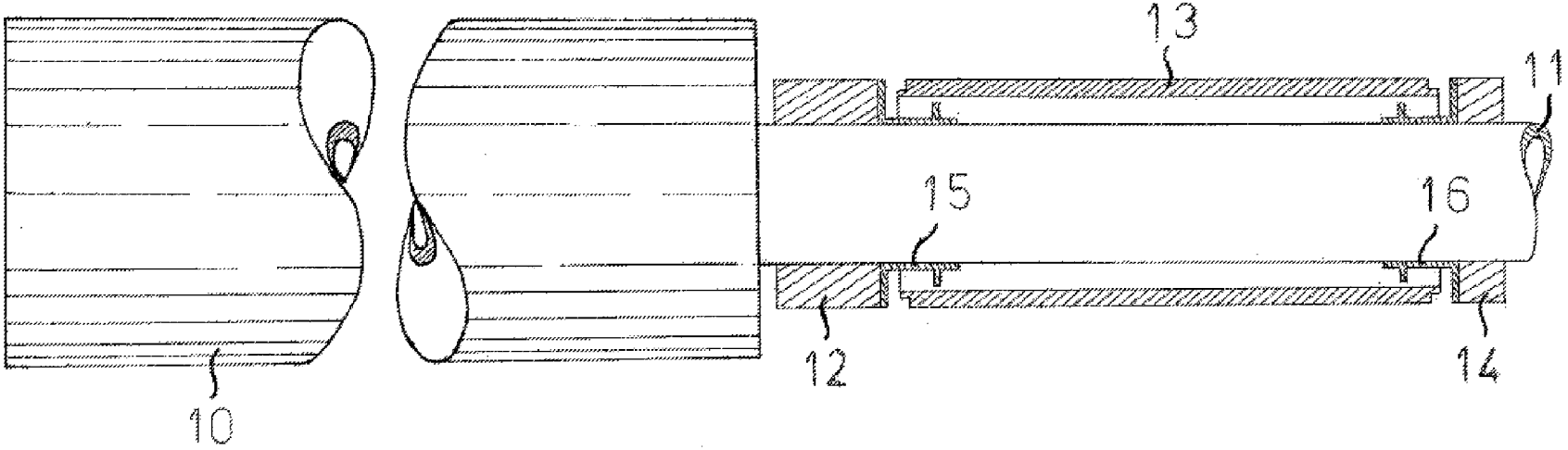
FIG. 4 shows a partial cross-section view of the mono-use cohesive stretch film baggage wrapping device of the invention, in a preferred embodiment illustrating the mounted film dispenser version number one for one-handed operation, as it would appear in final construction.
Figure 5:
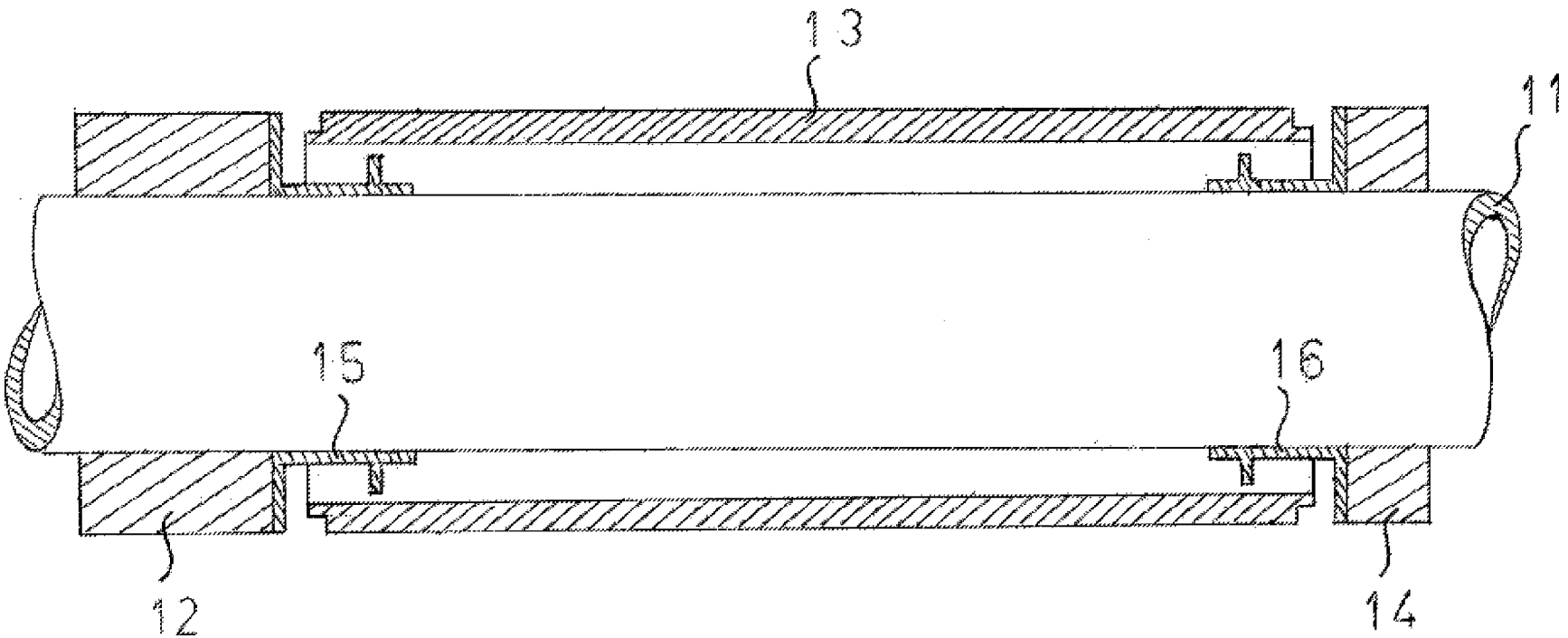
FIG. 5 illustrates film dispenser version number one, shows a enlarged cross-section view of inner stopper-ring, semi-compressible sleeve (without contoured guide-rings) as well as outer stopper-ring when assembled around extended core and contoured core guide-rings in a preferred embodiment as it would appear in final construction.

Considering the above and with reference to dispenser version number one FIG. 4, FIG. 5, encircling the core extension 11 and its guide-rings 15 and 16 is a semi-compressible sleeve 13 with contoured front ends. Said semi-compressible sleeve is located in-between of two secured stopper-rings 12 and 14 as well as two lateral flanks of core guide-rings 15 and 16 to prevent said sleeve from separating from the core extension during rotation no matter what angle or position the wrapping device is being hand-held at The dispenser version one FIG. 4, FIG. 5 semi-compressible sleeve 13 inner diameter would be somewhat greater than the outer diameter of the core 11 and its contoured guide-rings 15 and 16 while free rotation of core is provided by the two contoured guide-rings 15 and 16 which outer diameter would be slightly smaller than the inner diameter of said semi-compressible sleeve 13. The total spacing between the two stopper-rings 12 and 14 including the two laterals flanks of core guide-rings 15 and 16 is greater than the total length of the semi-compressible sleeve 13, as shown in FIG. 5, so there is endwise freedom for free rotation.

The contoured guide-rings 15 and 16 loosely fitting over core 11 are providing both lateral and internal rotating guidance of sleeve. Both contoured guide-rings are designed to give said guide-rings only very limited direct surface contact exposure with sleeve 13. thus providing low inertia and optimal free rotating abilities of core 11 necessary when freely drawing cohesive film of up to 12 inches, 304.80 mm in width off roll single-handed.

Figure 6:
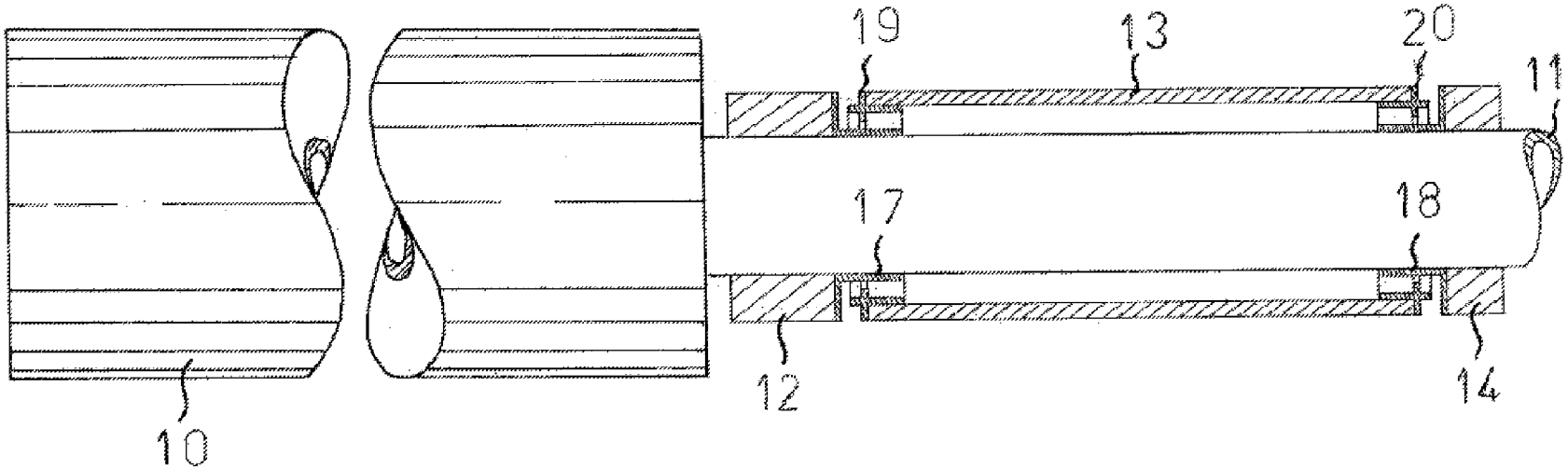
FIG. 6 shows a partial cross-section view of the mono-use cohesive stretch film baggage wrapping device of the invention, in a preferred embodiment illustrating the mounted film dispenser version number two for one-handed operation, as it would appear in final construction.

Referring to dispenser version number two, as shown in FIG. 6, FIG. 7, encircling the core extension 11 and its guide-rings 17 and 18 is a semi-compressible sleeve 13 with two embedded, secured by bonding media, contoured guide-rings 19 and 20 forming a single entity with sleeve 13. Said semi-compressible sleeve and embedded contoured guide-rings are located in-between of two secured stopper-rings 12 and 14 as well as two lateral flanks of core guide-rings 17 and 18 to prevent said sleeve and its guide rings from separating from the core extension during rotation no matter what angle or position the wrapping device is being hand-held at.

As will be readily apparent, as shown in FIG. 7, the inner diameter of the semi-compressible sleeve 13 would be somewhat greater than the outer diameter of the core 11 and its guide-rings 17 and 18 while free rotation of same is provided by two embedded and secured contoured guide-rings 19 and 20, which inner diameter would be slightly greater than the outer diameter of said core guide-rings The total spacing between the two stopper-rings 12 and 14 including the two lateral flanks of core guide-rings 17 and 18 is greater than the combined total length of the semi-compressible sleeve 13 with incorporated contoured guide-rings 19 and 20 included as shown in FIG. 7, so there is endwise freedom for free rotation.

The contoured guide-rings 19 and 20 are secured inside the semi-compressible sleeve 13 by bonding media forming a single entity with sleeve, are providing both lateral and internal rotating guidance of sleeve. Both contoured guide-rings are designed to give said guide-rings and said sleeve only very limited direct surface contact exposure with extended core guide-rings 17 and 18 which are loosely fitting over core 11 and indirectly with both lateral stopper-rings 12 and 14 (FIG. 7) thus providing low inertia and optimal free rotating abilities of core 11 necessary when freely drawing cohesive film of up to 12 inches, 304.80 mm in width off roll single-handed.

As with regard to dispenser version three as shown in FIG. 8, FIG. 8/A encircling the core extension 11 is a semi-compressible sleeve 13 with contoured front ends and a freely rotating clockwise or anti-clockwise direction coiled (clockwise or anti-clockwise coiling depending on unwinding direction of film from off the roll) around core 11 spiral-shape flexible sheet 22. Both said semi-compressible sleeve and spiral-shape flexible sheet are located in-between two lateral washers 21 and two secured stopper-rings 12 and 14 to prevent said sleeve and spiral-shape flexible sheet from separating from the core extension during rotation no matter what angle or position the wrapping device is being hand-held at.

The semi-compressible sleeve 13 inner diameter would be somewhat greater than the outer diameter of the core 11 while free rotation of latter is provided by the around core 11 clockwise or anti-clockwise direction coiled (FIG. 8/A) spiral-shape flexible sheet 22 located in between the outer diameter of core extension 11 and inner diameter of sleeve 13. The spiral-shape flexible sheet 22 outer and inner diameter, due to the coiled spiral expansion effect, adapts automatically to the inner diameter of said semi-compressible sleeve 13 and outer diameter of core 11 (FIG. 8/A). The total spacing between the two stopper-rings 12 and 14 including both lateral washers 21 is greater than the total length of the semi-compressible sleeve 13 and total width of the spiral-shape flexible sheet 22 which is slightly larger endwise than sleeve 13, as shown in FIG. 8, so there is endwise freedom for free rotation.

The washers 21 fitting freely over core 11 are providing together with both secured stopper-rings 12 and 14 lateral guidance and reduced lateral friction of both sleeve 13 and spiral-shape flexible sheet 22. The around core 11 clockwise or anti-clockwise coiled and freely rotating spiral-shape flexible sheet 22 provides internal rotating guidance of sleeve and eliminates due to its presents and spiral expansion effect any direct surface contact between sleeve 13 and core 11 keeping sleeve 13 in a free-floating manner and almost equally centered around core 11, thus providing extremely low inertia and optimal free rotating abilities of core 11 necessary when freely drawing cohesive film of up to 12 inches, 304.80 mm in width off roll single-handed.

Concerning dispenser version four, as shown in FIG. 9 encircling the core extension 11 is a semi-compressible sleeve 13 with two embedded, secured by bonding media, guide rings 23 forming a single entity with sleeve 13. Said semi-compressible sleeve with embedded guide rings is located in-between two lateral washers 21 and two secured stopper-rings 12 and 14 to prevent said sleeve from separating from the core extension during rotation no matter what angle or position the wrapping device is being hand-held at.

Both of the semi-compressible sleeve embedded guide rings 23 inner diameter would be somewhat greater than the outer diameter of the core 11 while free rotation of core is provided by the limited surface contact of sleeve embedded guide rings 23 with core 11 and washers 21

Thus providing extremely low inertia and optimal free rotating abilities of core 11 necessary when freely drawing cohesive film of up to 12 inches, 304.80 mm in width off roll single-handed.

The washers 21 fitting freely over core 11 are providing together with secured stopper-rings 12 and 14 lateral guidance and reduced lateral friction of sleeve 13 and embedded guide rings 23. The reduced lateral friction achieved is especially important when device is held in a downward pointing position which is the preferred baggage wrapping position of the device.

The total spacing between the two stopper-rings 12 and 14 including both lateral washers 21 is greater than the combined total length of the semi-compressible sleeve 13 with incorporated guide-rings 23 as shown in FIG. 9, so there is endwise freedom for free rotation.

In operation, with either dispenser embodiment, the user merely holds onto the sleeve without applying any pressure to sleeve 13 as the stretch-film is being drawn off freely, with the core extension 11 rotating freely within the sleeve.

Also shown are two stopper-rings 12 and 14 having both an inner diameter which is just slightly greater than the outer diameter of the core extension 11 so as to fit there over closely and to be secured in the desired position by bonding media when the device is being assembled. Both stopper rings 12 and 14 have an outer diameter greater than the inner diameter of the semi-compressible sleeve 13 but equal or slightly greater than the outer diameter of sleeve 13, as shown in FIG. 5, FIG. 7, FIG. 8, and FIG. 9.

One stopper-ring 12 is secured at the very beginning of the single end core extension 11 and the second stopper-ring 14 is secured at about one inch prior to the remote end of the extension (FIG. 4), so as to prevent the in-between of both stopper-rings and core guide rings 15, 16 and 17, 19 or washers 21 where applicable rotating semi-compressible sleeve 13 (FIG. 5, FIG. 7, FIG. 8, FIG. 9) and spiral-shape flexible sheet 22 where applicable (FIG. 8) from separating from the core extension during rotation no matter what angle or position the wrapping device is being hand-held at.

In particular will be noted that the stopper-ring 12 placed at the very beginning of the single end extension has two main functions: First, to prevent the sleeve from separating from the core extension. Second, being same in a natural position as with regard to the location of the users hand when holding the sleeve, to act as brake when being grasped between the thumb and forefinger of the user (FIG. 10) to prevent rotation of the core extension when the film is stretched, to be broken from the roll.

Use has shown that due to the multitude of positions and angles to be assumed during the baggage wrapping process as well as the individual handling of the device, the user needs more than one brake action at his/her disposal to suite individual convenience and ease of use while wrapping. Brake action must be at disposal at almost any position or angle without having to change hand or position of hand therefrom arising the need for ample brake action possibilities.

The device in question offers the following three independent brake actions, independently of the intensity of stretch required or position or angle assumed, as well as to avoid awkward handling when twisting of device is needed to frequently change wrapping direction:

First, the combination of the stopper-ring 12, fitted around the core extension 11, provides a very reliable braking action when it is desired to stretch the film or break it off, as the combined clamping pressure of the thumb and index finger (FIG. 10) on the stopper-ring 12 prevents any continued rotation of the core extension 11 and the roll 10.

In effectuating this, all that is necessary (besides providing the required fit between the stopper-ring 12 and core extend 11 so that the pressure on the stopper-ring 12 will prevent the continued rotation of the core extension 11), is to dimension the length of the core extend 11, the width of the stopper-ring 12, the wall thickness of core guide-rings or washers where applicable (FIG. 8, FIG. 9), the combined length of the sleeve 13 and width of spiral-shape flexible sheet 22 where applicable (FIG. 8) as well as the width of the second stopper-ring 14 (FIG. 4), so when grabbing the sleeve the user's hand will be able to simultaneously span the sleeve 13 and cover with its thumb and forefinger an appreciable portion of the stopper-ring 12 which is located in a natural position as with regard to the position of the hand (FIG. 10), and clamping same between both said fingers at the same time when braking is required.

To stretch the film or break it off, in this manner, the user merely tightens up the clamping pressure of thumb and index finger of his, or her, hand around the stopper-ring 12 (FIG. 10) so as to brake further rotation of the core extend 11 and roll 10.

Figure 11:
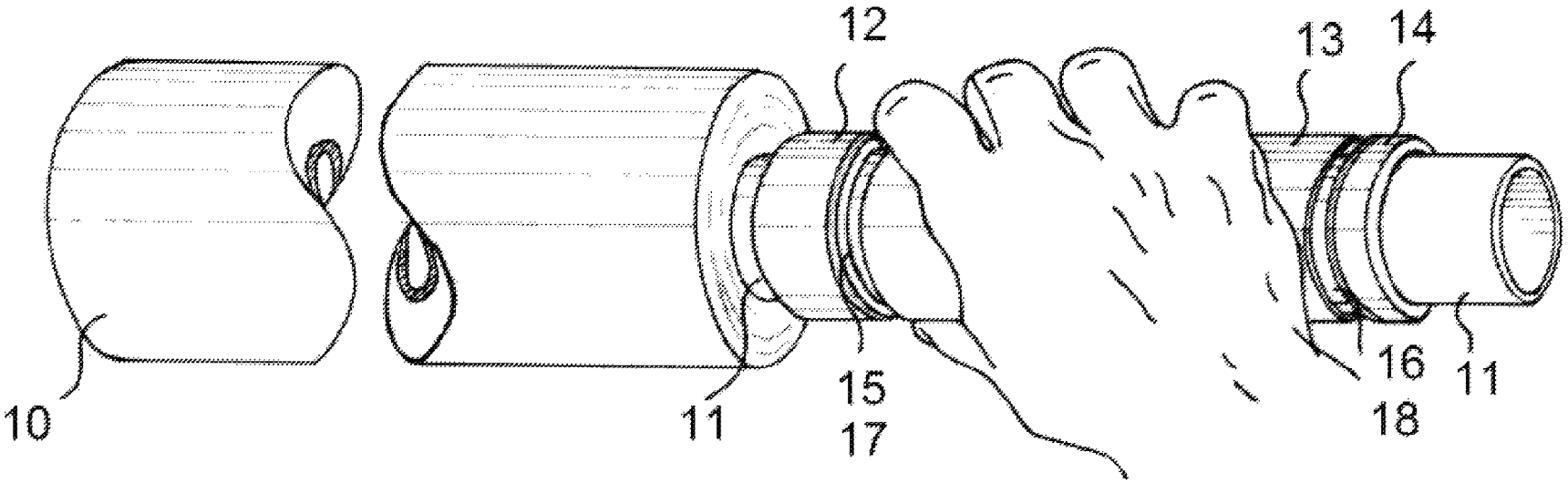

Second, if deemed more suitable, all that's required is to grasp the semi-compressible sleeve 13 with a hand and use thumb and index finger at the same time to apply pressure to the area of the sleeve where thumb and index finger making natural contact with sleeve (FIG. 11).

The pressure applied to the sleeve 13 by thumb and index finger will cause the extended core guide rings 15, 16 or 17, 19 or spiral-shape flexible sheet 22 where applicable to apply immediately friction with the inner guide of the in-between core guide-rings and sleeve laying contoured guide-ring 19 and 20 or guide rings 23 or directly with sleeve 13 itself, depending on version of film dispenser. Those combined simultaneous actions and reactions brake rotation of the core extend 11 and roll 10.

To stretch the film or break it off, in this manner, the user merely tightens up the clamping pressure of thumb and index finger of his, or her, hand around the semi-compressible sleeve 13 (FIG. 11) so as to brake further rotation of the core extend 11 and roll 10.

Figure 3:
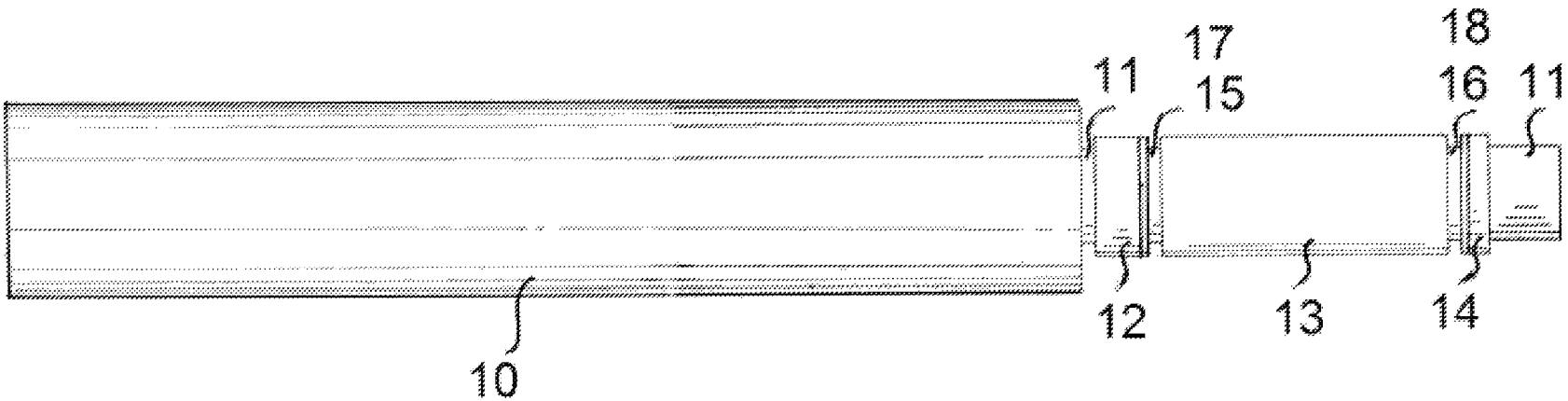
FIG. 3 schematically illustrates the mono-use cohesive stretch film baggage wrapping device of the invention in reduced scale, in a preferred embodiment for one-handed operation, as it would appear in final construction.

Third, depending on the users convenience or ease of use and especially when device is in a vertical position with roll pointing downwards, a further brake action can be achieved by slightly letting hand slide backwards in direction of the tail section of the remote end of the extension 11 (FIG. 12), where about one inch of exposed core 11 is visible (FIG. 3). To achieve the required brake action, let hand slide until the baby finger gets in contact with said remote end of the core extension (FIG. 12) then use the baby finger to grasped core, only a slight squeeze around core by baby finger is required to brake further rotation of core extend 11 and roll 10.

To stretch the film in this manner, the user merely tightens up the clamping pressure of baby finger of his, or her, hand around the core extend 11 (FIG. 12) so as to brake further rotation of the core extend 11 and roll 10.

Figure 13:
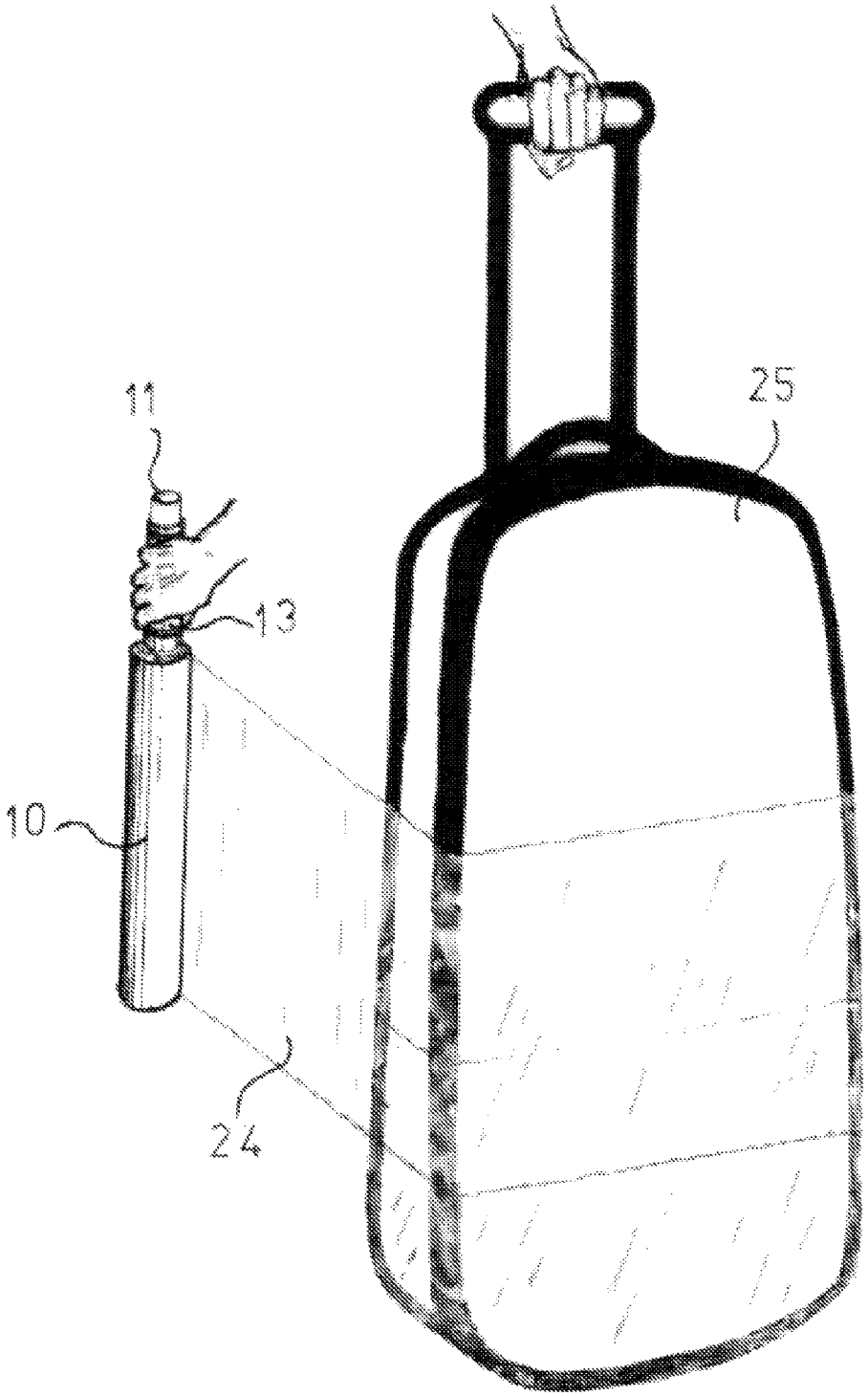
FIG. 13 shows a perspective view and common method of the stretch film being applied by the invention to a baggage.

When wrapping and protecting baggage all that's required is to manually proceed and handle the device as follows (FIG. 13):

First, a piece of baggage 25 is placed on a convenient support base (floor, table etc.) ready for the packing procedure.

Second, a sufficient length of ca. 2 ft (60 cm) of stretch-film 24 is drawn freely by hand from the device without stretching and the beginning of film with the outer end first is secured by hand to the baggage, where it will adhere, slight tension is kept on the film by using anyone of the device's single brake actions (FIG. 10, FIG. 11, FIG. 12) available while simultaneously drawing further footage off roll and simple encircle wrapping the baggage just once until the beginning of film 24 has been fully overlapped thus ensuring sufficient adherence and anchorage of film around baggage and to itself and permitting to continue with the actual progressive spiral and stretch wrapping process while keeping film under slight tension and proceeding, as indicated next.

Third, with the film 24 already attached to baggage and under slight tension, another 1½-2 ft (45-60 cm) of film at a time are freely drawn, without stretching, off roll, thereafter using anyone of the device's single brake actions available (FIG. 10, FIG. 11, FIG. 12), the film is then stretched about 50-100% obtaining about 2-3 ft (60-90 cm) of stretched film which is then tightly spiral-wrapped, by keeping film under tension, around the baggage where it will, being cohesive, automatically adhere to the baggage and/or to itself.

By spiral-wrapping, the film 24 must overlap (FIG. 13). the previous layer of film about 50% or to such extend to provide complete wrapping coverage of baggage.

Change of wrapping direction from horizontal to vertical or vice versa, without the necessity of cutting film, is achieved by simply twisting the device about 180°-360° with same hand and proceeding with wrapping as usual in new direction.

Figure 10:
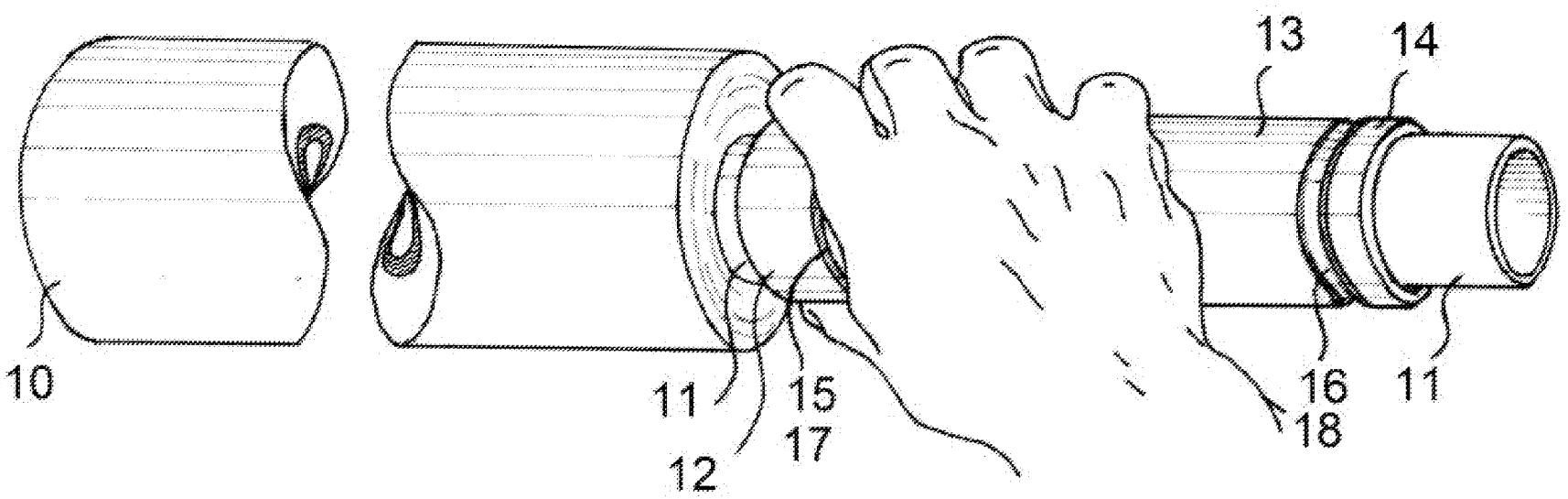
FIG. 10 shows the invention, in a preferred embodiment for one-handed operation and use of the inner stopper-ring as reliable braking action as it would appear during wrapping.
Figure 12:
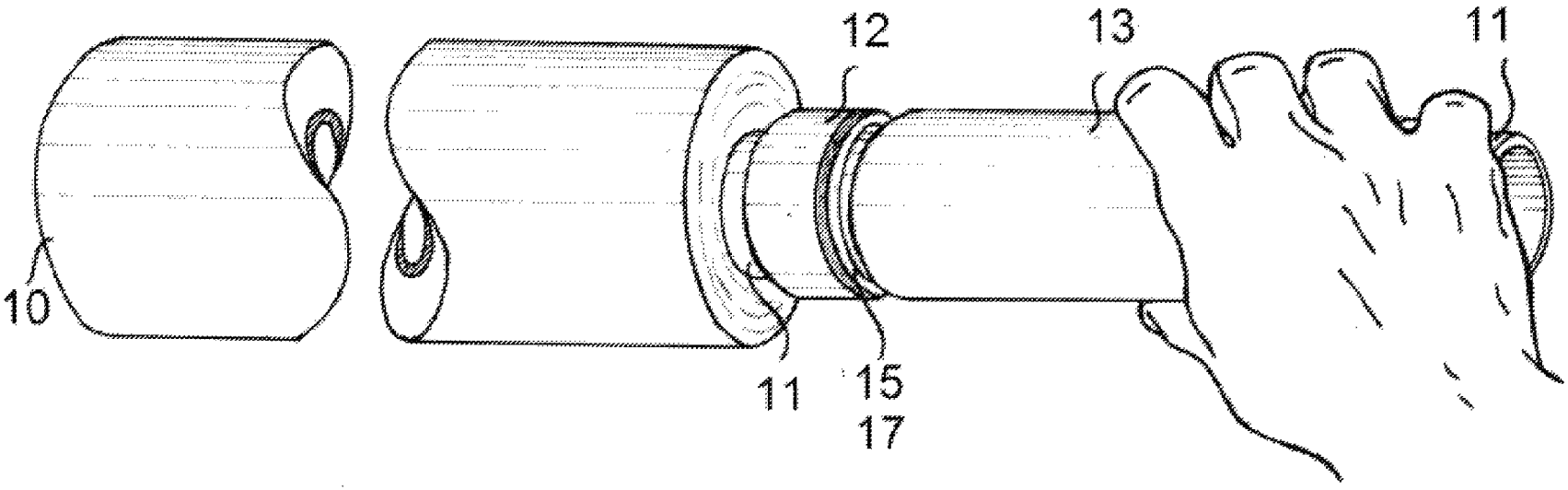

Fourth, previous step 3 must be repeated until and when the baggage 25 is completely spiral-wrapped and the single-use stretch film 24 provided on roll is exhausted, or using any of the brake action provided, as shown in FIG. 10, FIG. 11, and FIG. 12, together with twisting device 360° to brake film off roll and to interrupt wrapping.

Fifth, when wrapping is terminated, the free end of the stretch film 24 is then secured to the wrapped piece of baggage to complete the process and an adhesive security label, supplied with device, is placed over the free end to avoid accidental loosening of same during transport. After this, all remaining parts of the mono-use device can then be safely disposed of as same is 100% bio-degradable and recyclable.

The baggage wrapping results obtained, including the application of the adhesive security label when wrapping is terminated, are at par with machine wrapping quality and time required for hand wrapping baggage is similar to machine wrapping depending on personal ability.

The device is easy, safe and inexpensive and provides the best combination at present of cost-effectiveness and ease and can be used by anybody, whether right or left-handed, and with almost any type of baggage including golf clubs, skies etc.

Whereas there have been described what are considered to be preferred embodiments of the present invention, it will be appreciated that modifications can be made by those skilled in the art without departing from the scope of the teachings herein. Such modifications are to be considered within the context of the present invention where a roll of stretch film contains cohesive stretch film of up to 12 inches, 304.80 mm in width where an semi-compressible sleeve with or without two embedded contoured guide-rings or guide rings located between two stopper-rings and washers, the extended core holds contoured guide-rings or guide-rings or a clockwise/anti-clockwise direction coiled spiral-shape flexible sheet, the sleeve held by the user and the core extends freely permitted to rotate within in a manner that does not transmit any friction to the user's hand, where two stopper-rings and washers preventing also the sleeve and guide-rings from separating from the core extension, and where the pressure of the thumb and index finger of the hand on one of the stopper-rings as well as the semi-compressible sleeve and in addition the pressure of baby finger on part of the remote end of the core extension, prevents further rotation of the core in permitting stretch-film of up to 12 inches, 304.80 mm in width being stretched.

Obviously, different configurations can be employed for the "stopper-rings", "washers" "semi-compressible sleeve" contoured guide-rings, "guide rings", "clockwise and anti-clockwise direction coiled around core spiral-shape flexible sheet" as well as "stopper-ring secured at about one inch prior to the remote end of the extension", and different dimensioning can be employed for the component parts than are illustratively shown in the drawings, and still carry through on the manners in which the wrapping device operates as herein described.

As to a further discussion of the manner of usage and operation of the present invention, the same should be apparent from the above description. Accordingly, no further discussion relating to the manner of usage and operation will be provided.

With respect to the above description, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A single handed device for film wrapping comprising; a roll of film on a core with a single end extension attached to said core having a semi-compressible sleeve rotate on a plurality of embedded contoured guide-rings and core embedded guide-rings attached to said core with said sleeve being between a pair of stopper-rings connected to said core where said contoured guide-rings having an outer diameter slightly smaller than the inner diameter of said sleeve and where the total spacing between the two stopper-rings is greater than the combined total length of the semi-compressible sleeve with incorporated contoured guide-rings.

2. A device according to claim 1 further comprising said device being recyclable.

3. A device according to claim 1 further comprising said sleeve being semi-compressible.

4. A device according to claim 1 further comprising said device is bio-degradable within.

5. A device according to claim 1 further comprising said film comes off when rotating the roll in a clockwise direction.

6. A device according to claim 1 further comprising said device being used to wrap baggage.

7. A device according to claim 1 where said sleeve and guide-rings are constructed of hard cardboard material.

* * * * *